US005512408A

United States Patent [19]

Baird et al.

[11] Patent Number: 5,512,408

[45] Date of Patent: Apr. 30, 1996

[54] DRY TONER WITH GELLED RESIN FOR HIGH SPEED PRINTER

[75] Inventors: Brian W. Baird, Louisville; George P. Marshall, Boulder; Michael G. Miller, Longmont; James C. Minor, Niwot, all of Colo.

[73] Assignee: Lexmark International, Inc., Greenwich, Conn.

[21] Appl. No.: 496,848

[22] Filed: Jun. 23, 1995

[51] Int. Cl.[6] ..... G03G 9/087; G03G 9/097; G03G 13/08

[52] U.S. Cl. ..... 430/110; 430/120

[58] Field of Search ..... 430/110, 120

[56] References Cited

U.S. PATENT DOCUMENTS

| | | | |
|---|---|---|---|
| Re. 31,072 | 11/1982 | Jadwin et al. | 430/99 |
| 4,556,624 | 12/1985 | Gruber et al. | 430/110 |
| 5,180,649 | 1/1993 | Kukimoto et al. | 430/110 X |
| 5,334,474 | 8/1994 | Abbott et al. | 430/110 |
| 5,352,556 | 10/1994 | Mahabadi et al. | 430/110 X |
| 5,418,104 | 5/1995 | Lawson | 430/110 |

*Primary Examiner*—Roland Martin
*Attorney, Agent, or Firm*—John A. Brady

[57] ABSTRACT

A toner for a two component developer used in a high speed computer output printer has about 20 parts gelled styrene/acrylic resin, 40 parts acrylate resin, about 13 parts hydrogenated wood rosin ester with pentaerythritol, and about 18 parts rosin ester of pentaerythritol, as well as carbon black and a charge control agent. Exceptional improvement is noted in carrier deterioration, fuser roller life and photoconductor filming.

4 Claims, No Drawings

DRY TONER WITH GELLED RESIN FOR HIGH SPEED PRINTER

TECHNICAL FIELD

This invention relates to dry toner for use in a two component developer for a high speed printer. The invention modifies a previous formula by incorporating gelled resin.

BACKGROUND OF THE INVENTION

A previous, commercially sold toner for the IBM 3825 printer is a mixture of several resin components, a charge control agent, and carbon black as a colorant. The 3825 printer employs periodic movement of its photoconductor to replace the previous photoconductor surface as it becomes inoperative from toner filming, periodic replacement of its carrier as the carrier becomes inoperative from toner filming, and periodic replacement of its fuser roller from wear in the region between that occupied by an 11 inch wide paper and remainder of the 14 inch wide fuser roller. Such replacement requirements have not been excessive, and the prior art is not known to teach that they could be further minimized or avoided with a different toner.

It is well recognized in the prior art that use of a gelled (cross-linked) toner does reduce offset of toner to the fuser. U.S. Pat. Nos. 5,334,474 to Abbott et al, 4,556,624 to Gruber et al and Re. 31,072 to Jadwin et al are illustrative. The first patent employs as one resin the same gelled resin as is employed in this invention. The use of a gelled resin just to avoid offset to the fuser roller is often an uneconomic or excessive choice, since the fuser roller can be modified to reject or lose toner in various ways such as by employing a fluorocarbon surface, by oil treatments and by cleaning by mechanical scraping of the fuser roller.

This invention replaces linear resin in a previous toner formula with the same polymer in gelled form. The broad range of benefits obtained by using the gelled resin in accordance with this invention are unexpected and so significant as to warrant use of the gelled resin.

DISCLOSURE OF THE INVENTION

This invention is a toner for a charged image which replaces a linear copolymer of styrene/n-butyl methacrylate with highly gelled (about 80%) styrene/n-butyl methacrylate, the gelled cross-linking agent being divinyl benzene. Specifically, the toner comprises about 40 parts by weight of a copolymer of n-butyl methacrylate and methyl methacrylate, and about 20 parts by weight of a copolymer of about 80 parts by weight styrene and about 20 parts by weight butyl acrylate about 80 percent crosslinked with divinyl benzene. Exceptional improvements are realized in photoconductor life, carrier life, and fuser life. The toner is formulated and employed with the IBM 3825 printer, a high-speed, xerographic output printer for large computers.

BEST MODE FOR CARRYING OUT THE INVENTION

The chemical formula for the toner of this invention is as follows:

| Material | % by Wt. |
|---|---|
| Styrene/butyl acrylate, 80% gelled with divinyl benzene (approximately 80% styrene, 20% butyl acrylate by weight) (Pliotone CPR 7212 product of Goodyear Tire and Rubber Co.) | 19.7 |
| 60/40 n-butyl methacrylate/methyl methacrylate (B-1100, product of Zeneca Resins). | 41.0 |
| Ester of rosin prepared by the esterification of nearly completely hydrogenated wood rosin with pentaerythritol (Foral 105, product of Hercules, Inc.). | 13.0 |
| Pentaerythritol ester of rosin (PentalynX, product of Hercules, Inc.). | 18.3 |
| Carbon black (Raven 1020, product of Colombian Chemical Co.). | 7.5 |
| CETATS (Cetyl trimethyl ammonium para-toluene sulfonate, for charge control, product of Hexcel Chemical Products Ltd.). | 0.5 |

Processing is essentially by a standard dry toner process. The ingredients are separately introduced in a mixer as powders of 100 to 300 micron size. When blended in the mixer, the blend is passed through an extruder. The blend is melted by heat and extruded as small pellets (air rifle BB sized). These are ground into a powder by intercollisions in a jet mill, with a median particle size of about 10 microns. The final classified range is 11.3±0.7 microns particles, with less than 1.5% of less than 5 microns and between 4 and 12% greater than 16 microns.

Especially in the initial toner mix, particle size is important to assure that paper on the photoconductor releases after transfer of the image.

The carrier for this toner is 90% spherical steel core and 10% irregular iron core, both coated with conductive carbon black filled epoxy-fluorocarbon. The fluorocarbon coating is to discourage filming of toner on the carrier. Nevertheless, most dual component developer system ultimately fail by toner permanently adhering to the carrier. This, in turn, prevents the proper charging of the existing and replenishment toner (toner alone normally being added to replace that use). Moreover, toner film on carriers can significantly decrease the conductivity of the developer mix (i.e., the toner and carrier), thereby decreasing the efficiency of the mix—especially as a cleaner, which is one function of the developer.

The foregoing toner used in the IBM 3825 printer appears to virtually eliminate such toner filming of toner on the carrier.

In the IBM 3825 printer the foregoing toner appears to greatly delay the failure of the fuser roll caused by differential wear of the predominant 11 inch paper being fused on the 14 inch wide fuser roll. Differential fuser roll wear from the abrasive nature of paper results in variations in fuser residence time through the fusing zone or fuser nip. The benefit afforded by the foregoing toner is that it allows the fuser roll to run at a hither temperature operating point without fear of toner offset to the fuser roll, thereby reducing the sensitivity of the fuser roll/toner pair to variations in fuser residence time and the resulting failure.

In the IBM 3825 printer the foregoing toner substantially reduces the filming of toner on the photoconductor, thereby reducing the premature advancement of this expensive element.

The IBM 3825 has a photoconductor with outer layer characterized by being a polycarbonate with hydrozone transport molecule, and a fuser roller of fluorosilicone elastomer body coated with silicone oil (DC200 (12,500 cs) polydimethyl siloxane, a product of Dow Corning).

What is claimed:

1. A dry toner comprising a resin body, a charge control agent, and carbon black, said resin body comprising about 40 parts by weight of a copolymer of n-butyl methacrylate and methyl methacrylate, and about 20 parts by weight of a copolymer of about 80 parts by weight styrene and about 20 parts by weight butyl acrylate about 80 percent cross linked with divinyl benzene, an ester with pentaerythritol rosin of nearly completely hydrogenated wood rosin, and an ester of rosin with pentaerythritol.

2. The toner as in claim 1 in which said cross linked copolymer is about 19 parts by weight of said toner, said ester with hydrogenated wood rosin is about 13 parts by weight of said toner.

3. A method of toning a charged image in an IBM 3825 printer comprising toning said image with a two component developer of carrier and a toner comprising a dry toner comprising a resin body, a charge control agent, and carbon black, said resin body comprising about 40 parts by weight of a copolymer of n-butyl methacrylate and methyl methacrylate, and about 20 parts by weight of a copolymer of about 80 parts by weight styrene and about 20 parts by weight butyl acrylate about 80 percent cross linked with divinyl benzene, an ester with pentaerythritol rosin of nearly completely hydrogenated wood rosin, and an ester of rosin with pentaerythritol.

4. The method as in claim 3 in which said cross linked copolymer is about 19 parts by weight of said toner, said ester with hydrogenated wood rosin is about 13 parts by weight of said toner.

* * * * *